United States Patent [19]

Czeczerski

[11] Patent Number: 4,633,857

[45] Date of Patent: Jan. 6, 1987

[54] MASSAGER

[76] Inventor: Nordfried Czeczerski, Freinsheimer Strasse 88, 6710 Frankenthal 4, Fed. Rep. of Germany

[21] Appl. No.: 604,639

[22] Filed: Apr. 27, 1984

[30] Foreign Application Priority Data

Apr. 26, 1983 [DE] Fed. Rep. of Germany ..... 3315041
Mar. 9, 1984 [DE] Fed. Rep. of Germany ... 8407237[U]

[51] Int. Cl.[4] ..... A61H 7/00

[52] U.S. Cl. ..... 128/50; 15/180; 74/31; 74/89.17; 128/53; 128/56

[58] Field of Search ..... 128/44, 48, 49, 50–53, 128/56, 57, 61, 65–67; 15/180; 74/29–31, 21 E, 21 R, 53, 89.17, 422

[56] References Cited

U.S. PATENT DOCUMENTS

| | | | |
|---|---|---|---|
| 921,991 | 5/1909 | Hood | 74/89.17 |
| 1,220,862 | 3/1917 | Lewis | 74/89.17 |
| 1,323,057 | 11/1919 | Holliday | 74/89.17 |
| 1,577,751 | 3/1926 | Paschall | 128/51 |
| 3,085,269 | 4/1963 | Greer | 15/21 R |
| 3,415,131 | 12/1968 | Zieber | 74/31 |
| 3,768,462 | 10/1973 | Boulard | 128/44 |
| 4,155,137 | 5/1979 | Kadlub | 4/606 |
| 4,228,557 | 10/1980 | DeVivo | 128/56 |
| 4,356,583 | 11/1982 | Wallasch | 15/21 E |
| 4,490,871 | 1/1985 | Martin | 128/56 |

FOREIGN PATENT DOCUMENTS

| | | | |
|---|---|---|---|
| 91032 | 10/1983 | European Pat. Off. | 4/606 |
| 463567 | 7/1928 | Fed. Rep. of Germany | 15/21 |
| 1228374 | 3/1960 | France | 74/89.17 |
| 182234 | 10/1983 | Japan | 15/21 R |
| 240838 | 8/1926 | United Kingdom | 74/89.17 |
| 631145 | 5/1978 | U.S.S.R. | 15/29 |

OTHER PUBLICATIONS

Placzko, German Publication 7,729,478, published 9/21/1978.

*Primary Examiner*—Clyde I. Coughenour
*Attorney, Agent, or Firm*—Kinzer, Plyer, Dorn & McEachran

[57] ABSTRACT

A massager with a vertical guide column (1) which has a cylinder/piston unit (10) and toothed racks (4) mounted at the side on the guide column (1). These toothed racks (4) engage pinions (5) which hold the brushes (7) which are mounted in housing halves (8) which slide up and down on the guide column (1). The housing halves (8) are connected by connecting rods (12) and a crossbar (11) to the piston rod (9) of the cylinder/piston unit (10). With the help of a control valve (15), automatic switching to the end positions of the brush unit can be achieved.

7 Claims, 14 Drawing Figures

MASSAGER

This invention concerns a massager with a rotating brush head which can be raised and lowered on a vertical guide column with the help of a cylinder/piston system operated with a pressure medium and which can be rotated and rolled on a drive bar, and the piston of the cylinder alternately receives pressure medium through a control valve.

Such a massager is known and has a rotating roller or brush mounted on a guide column which is designed as a square tube so the axis of the brush is at a right angle to the guide column. The brush or roller has a separate drive motor and moves up and down by the cylinder/-piston system with the pressure medium-operated cylinder attached to a water line. The cylinder has a double action design using a control valve. The main disadvantage of this known apparatus consists of the fact that there is only one brush and it must be provided with an extra drive motor. Another important disadvantage consists of the fact that additional separate mounting and attachment fixtures must be provided for the cylinder/piston unit. A single horizontal brush arrangement does not yield any particular massaging action.

This invention was based on the goal of proposing a massager which would assure a sturdy drive for the brushes while achieving an improved massaging action.

This goal is achieved according to this invention by means of the fact that a. The brush head has two brushes driven in opposite directions and each is attached to a shaft with a pinion and is mounted in a housing,
b. The pinions engage toothed racks on the side of the guide column, and
c. The housing surrounds the guide column.

It is advantageous that the piston which is mounted on a piston rod is attached to a crossbar which is connected to the housing with the help of connecting rods.

An advantageous feature consists of the fact that the piston is connected to the housing with the help of a traction cable which passes over upper and lower cable pulleys with driving belts on both sides of the housing.

It is proposed here that stops be provided on the crossbar and the housing to reverse the valve.

Another advantageous feature is that slits are provided in a housing cover in accordance with the path of movement to allow the brushes to pass through, and the brush heads are held in protective casings which have a shoulder that is guided in the slit.

In addition, it is also proposed that the guide column should be attached to a wall mount so that the height is adjustable.

Another advantageous version consists of the fact that the holder disk to which the brush heads can be attached is mounted on the brush drive shaft, in which case the holder disk has several holes into which the lips of elastic material can be inserted, and on the back of the brush head there are nipples which can be inserted into the lips.

It is also proposed that the brush heads should have a ring-shaped rim which can be placed over the edge of the holder disk.

It is also advantageous for the holder disk to have a shaft attachment nub with a matching recess provided in the brush head.

Finally, it is also proposed that pegs should be attached to the brush head in a porcupine fashion.

This invention offers the significant advantage that it provides an automatic massager that is composed of simple structural devices and is especially stable, and an especially good massaging action is achieved with the two brushes operating in opposite directions. The special structural advantage is also based on the fact that the piston/cylinder unit is centered by the brush unit itself in conjunction with the guide column. It is also significant here that the rotating brushes meet certain requirements because special forces and torques act on the brushes. The various options required for such massagers can easily be interchanged, and a stable mount is guaranteed for operating purposes. Another advantage of this arrangement of brushes is that operation involves simple steps and means. To replace a head, one brush head is simply removed and a new brush head is attached, and no screw couplings are required.

This invention is now explained in greater detail in the following description on the basis of practical examples illustrated in the figures.

Figure 1:
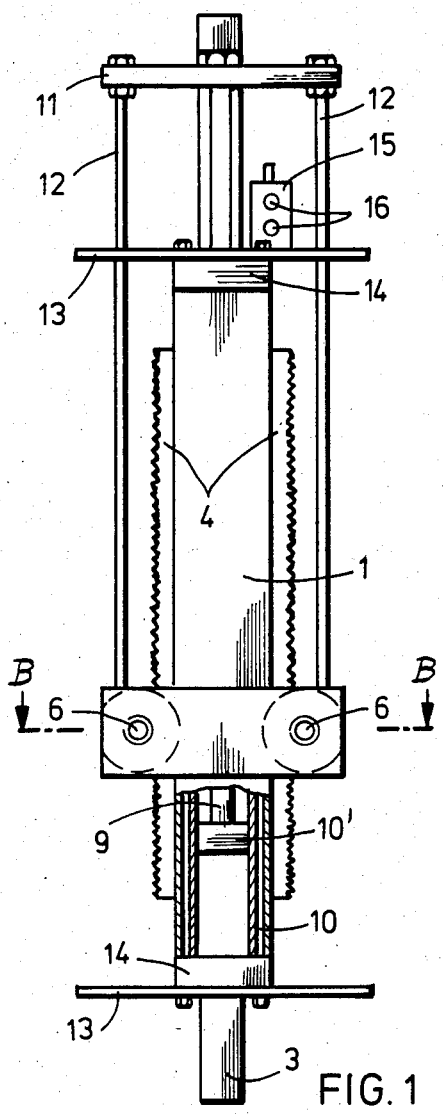
FIG. 1 shows one version of the massager according to this invention in sectional view, although the cover is not shown for the sake of simplicity.
Figure 2:
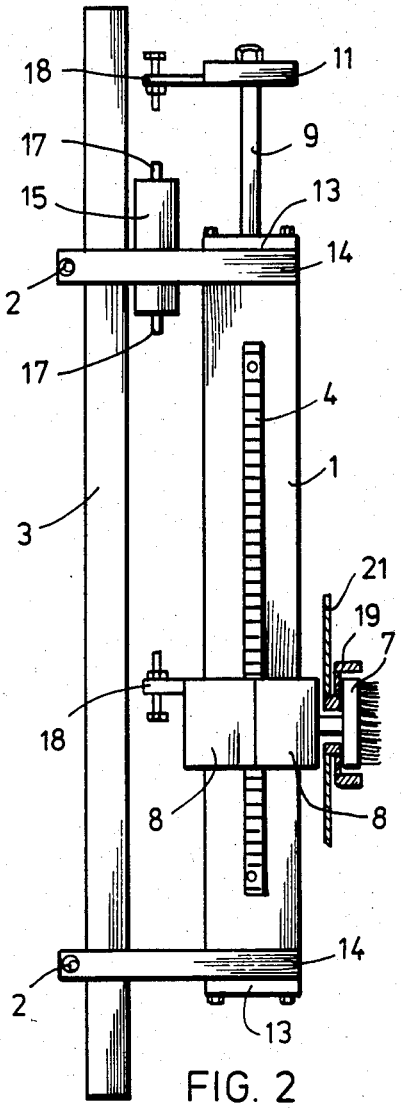
FIG. 2 shows a side view of FIG. 1.
Figure 3:
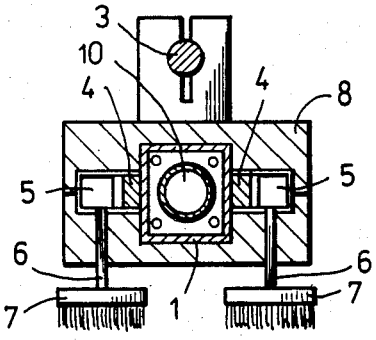
FIG. 3 shows a section according to line B—B in FIG. 1.

The massager illustrated in FIGS. 1 to 3 has a vertical guide column (1), preferably a square tube, and this column (1) is suspended at the top and the bottom with the help of clamping jaws (2) on a holder (3) which is attached to the wall. At the side of the guide column (1) there are toothed racks (4) which engage the pinions (5) with shafts (6) that have brushes (7). The pinions (5) as well as the shafts (6) and the brushes (7) are supported and mounted in a housing or brush head (8) which is preferably divided in the middle in the direction of the toothed racks (4), so the two halves of the housing (8) can slide on the guide column (1). The piston rod (9) of the cylinder/piston unit (10) with pistons (10') has a crossbar (11) at its upper end with connecting rods (12) on this crossbar (11) attached at the opposite end to the housing halves (8). In addition, there is a mounting plate (13) at the top and bottom of the guide column. This is where there are connecting plates (14) for pressure medium, and a control valve (15) is mounted on the top plate (13) with various connecting lines (16) attached to it. In addition, the valve (15) has switch pins (17) which work with the stops (18), such that one stop (18) is mounted on the housing (8) and another stop (18) is mounted on the crossbar (11).

Figure 4:
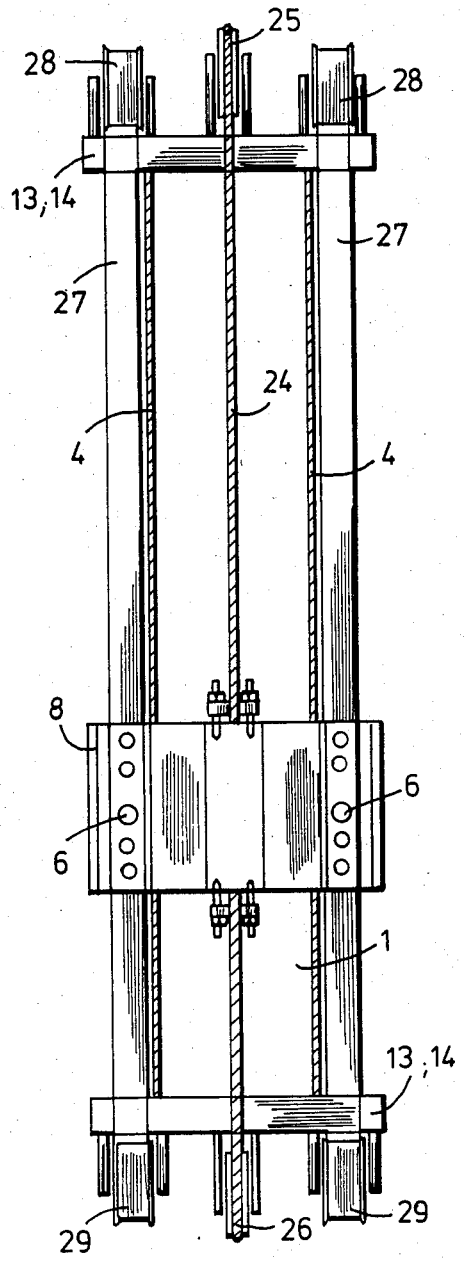
FIG. 4 shows another version of the massager according to this invention in sectional view, again without showing the cover.
Figure 5:
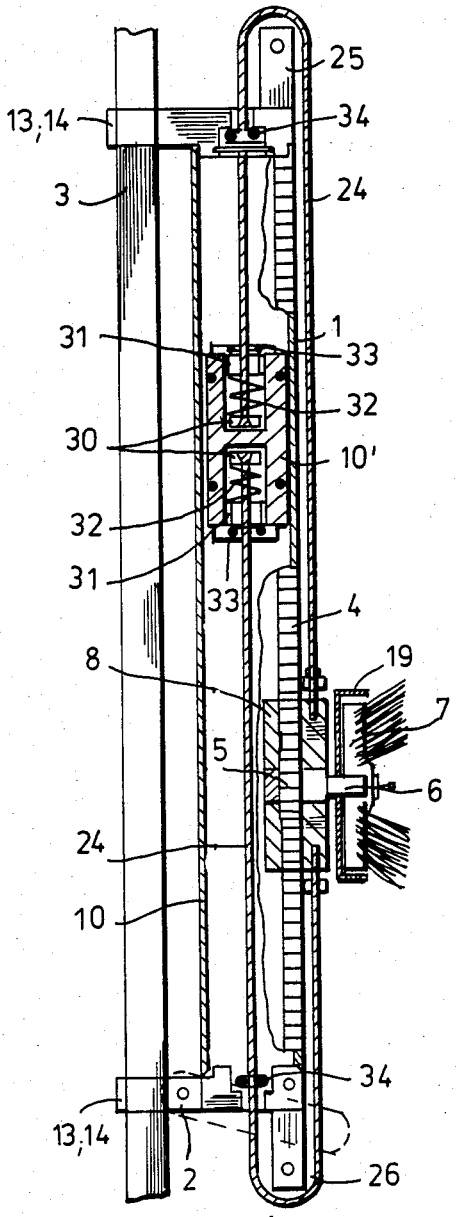
FIG. 5 shows a side view of FIG. 4 in cross section.

In the other version of the massager illustrated in FIGS. 4 and 5, the same parts have the same reference numbers as in the version illustrated in FIGS. 1 to 3. Unlike the version according to FIGS. 1 to 3, however, the drive of the housing (8) is by way of a traction cable (24) which is attached to the piston (10'). The traction cable (24) passes at one end over an upper cable pulley (25) to the housing (8) and in the other end over a lower cable pulley (26) to the housing (8). Toothed racks (4) mounted on the front edge are used to guide the housing (8) (FIG. 5) in which case the ends of the tension cable are attached to the housing (8) before the toothed racks (4). The traction cable ends are attached to the piston (10') at a holder nipple (30) with an inserted screw coupling (31) and a lag spring (32) is positioned between the holder nipple (30) and the screw coupling (31). Seals (33) are provided to seal the cable at the piston. Other seals (34) are provided at the upper and lower mounting plate (13) for the cable (24) where it leaves the cylinder (10).

Driving belts (27) are attached at the side to guide the housing (8) and are guided over upper and lower belt pulleys (28 and 29), so the cable pulleys (25, 26) and the belt pulleys (28, 29) are attached to the mounting plates (13).

Figure 6:
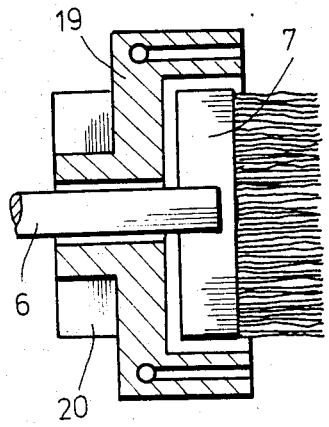
FIGS. 6 and 7 show a design of the protective casing for the brush head in different views.
Figure 7:
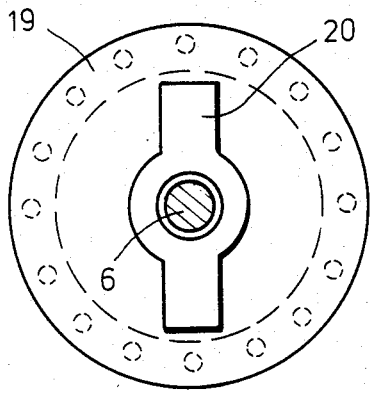

As shown by FIGS. 6 and 7 and indicated in FIG. 2, the brush (7) runs in a protective casing (19) so that only the bristles of the brush (7) project out of the housing. This protective casing can be designed as a type of shower head, as shown in FIGS. 6 and 7, so that in addition to the actual massage action due to the brushes (7), there can also be a shower effect in which case this protective casing (19) can be attached to the outlet water line of the cylinder/piston unit (10), so the water it discharges can be utilized suitably.

Figure 8:
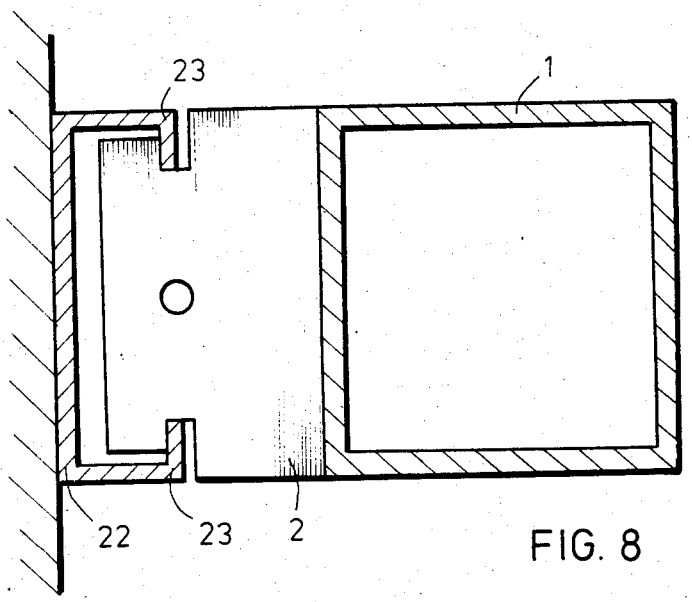
FIG. 8 shows another version for the design for the wall mount in top view.

FIG. 8 shows another possibility for mounting the device to a wall, where an especially leakproof mount is assured by the fact that a U-shaped holder (22) is attached to the wall and is provided with an internal grip hook (23) to hook into a holder attached to guide column (1), FIG. 8.

As soon as the supply of pressure medium to the cylinder/piston unit (10) is opened, the pressure medium flows in from one side and moves the brush unit into the end position, and by reversing the valve (15), the pressure medium flows in from the other side and the brush unit moves in the opposite direction, so the brushes (7) turn in opposite directions.

Figure 9:
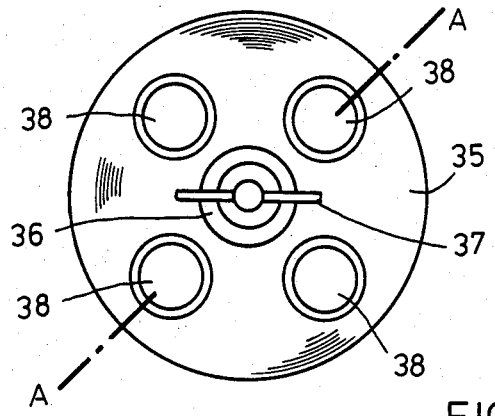
FIG. 9 shows a top view of the holder disk.
Figure 10:
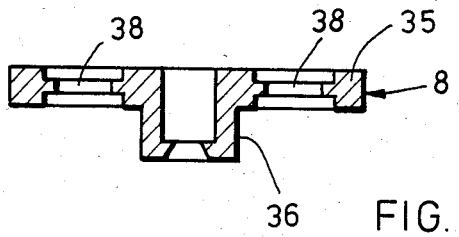
FIG. 10 shows a section according to line A—A in FIG. 9.
Figure 11:
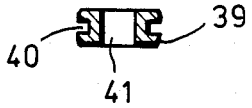
FIG. 11 shows a section through the lips inserted into the holder disk.

The holder disk (35) illustrated in FIGS. 9 and 10 is attached to a drive shaft (6) with a nub or boss (36) in the middle. In order for the disk (35) to be held on the shaft (6) so that it will not twist, there may be, for example, a transverse groove (37) which interacts with the corresponding pin on the shaft (6). In addition, there are several apertures or holes (38) in the disk (35) which narrow in the middle so as to hold the similarly shaped lips or grommets (39) which have grooves (40). These lips (39) are made of an elastic material with apertures (41) incorporated into them.

Figure 12:
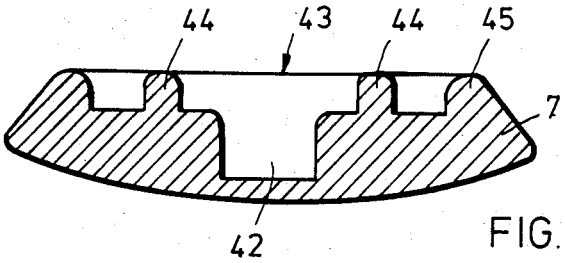
FIG. 12 shows a section through a brush head.

FIG. 12 shows the brush head (7) which fits the size of the holder disk (35), and there is a recess (42) to receive the nub (36). This brush head (7) is then attached to the holder disk (35) at the back, and there are nipples (44) on the back of the brush head (7) that correspond to the arrangement of lips (39) and can be inserted into the apertures (41). In addition, the brush head (7) with its ring-shaped outer rim (45) is placed over the edge (46) of the holder disk (35). The nipples (44) have a somewhat larger diameter than the corresponding holes (41) in the lips (39), so a good mount is assured.

Figure 13:
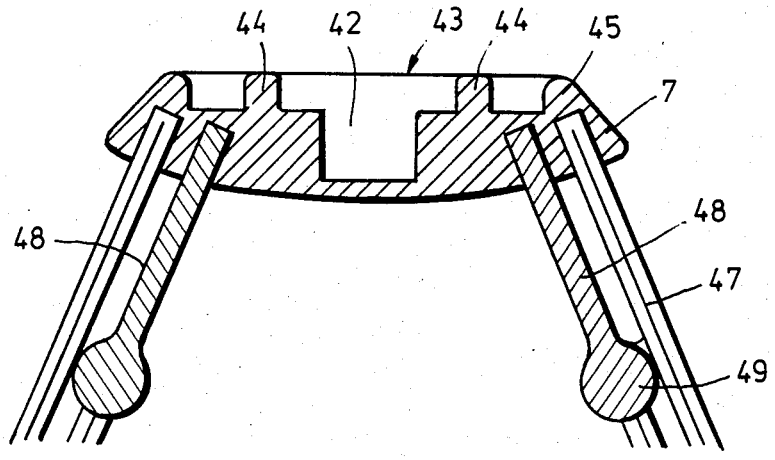
FIG. 13 shows a section through another version of such a brush.
Figure 14:
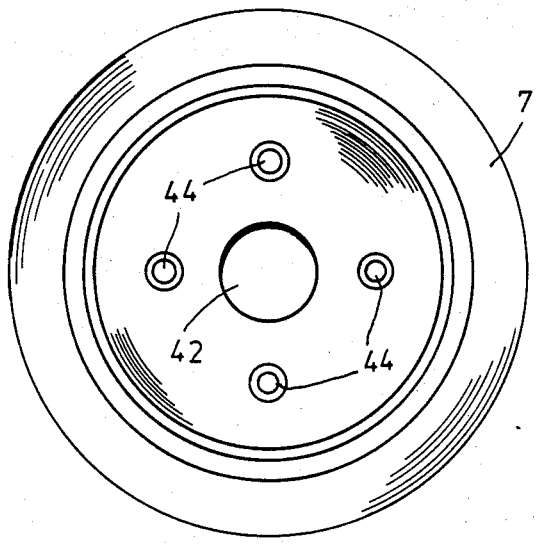
FIG. 14 shows a cross-sectional view of FIG. 13.

FIGS. 13 and 14 show the version of a special massaging brush with bristles (47) arranged in a ring-shape on the outside and pegs (48) with enlarged ends (49) pointing outward obliquely.

Reference numbers
1—Column
2—Clamping jaws
3—Holder
4—Toothed rack
5—Pinion
6—Shafts
7—Brushes
8—Housing
9—Piston rod
10—Cylinder/piston unit
10'—Pistons
11—Crossbar
12—Connecting rod
13—Upper mounting plate
14—Connecting plates
15—Control valve
16—Connecting lines
17—Switch pins
18—Stops
19—Protective casing
20—Shoulder
21—Housing cover
22—U-shaped holder
23—Hook
24—Traction cable
25—Upper cable pulley
26—Lower cable pulley
27—Driving belt
28—Upper belt pulley
29—Lower belt pulley
30—Holder nipples
31—Screw coupling
32—Lag spring
33—Seals
34—Seals
35—Holder disk
36—Nub
37—Groove
38—Holes
39—Lips
40—Grooves
41—Apertures
42—Recess
43—Back side
44—Nipple
45—Rim
46—Edge
47—Bristles
48—Pegs
49—Enlarged ends Key to FIG. 4.:
2—Slide
3—Cover (piston guide)
10—Belt pulley
11—Moving belts Key to FIG. 5.:
1—Piston guide column
2—Slide (valve)
5—Screw couplings
6—Lag (brake) springs 8—Holder nipples
9—O ring
10—Cable pulley
12—Drive pinion
20—Mounting rod
21—Adjusting lever
22—Brushes
23—Brush guard
a—Seger ring
b—Traction cable

I claim:

1. A massager with a brush head which can be raised and lowered as the brusher rotates in opposite directions comprising:

a. a vertical guide column with stationary toothed racks at the sides thereof,
b. a brush head surrounding the guide column,
c. two laterally spaced brushes which rotate in opposite directions mounted on the head,
d. each brush attached to a drive shaft having a pinion,
e. each pinion engaging one of the racks of the guide column,
f. a hydraulically operated cylinder piston system having the piston connected to the brush head whereby the piston can alternately receive pressure on either side through a control valve to reciprocate the brush head and rotate the brushes.

2. Massager according to claim 1 in which the housing comprises split halves.

3. Massager according to claim 1 in which the piston is connected to a cross bar and the cross bar in turn is connected to the brush head.

4. Massager according to claim 1 in which the piston is connected to the brush head by pulley-supported cables.

5. Massager according to claim 3 in which valve reversing stops are provided on the cross bar and the brush head.

6. Massager according to claim 1 in that each brush drive shaft has a holder disc, with apertures therein attached thereto, elastic grommets inserted in the apertures, and each grommet having an aperture for receiving attaching nipples of a brush back.

7. Massager according to claim 1 in which the brushes include both bristles and pegs with enlarged ends (FIG. 13).

* * * * *